US006428061B1

(12) United States Patent
Daoud

(10) Patent No.: US 6,428,061 B1
(45) Date of Patent: Aug. 6, 2002

(54) RETRACTABLE SAFETY MECHANISM FOR A CABINET

(75) Inventor: Bassel Hage Daoud, Parsippany, NJ (US)

(73) Assignee: Avaya Technology Corp., Miami Lakes, FL (US)

( * ) Notice: Subject to any disclaimer, the term of this patent is extended or adjusted under 35 U.S.C. 154(b) by 0 days.

(21) Appl. No.: 09/328,608

(22) Filed: Jun. 9, 1999

(51) Int. Cl.[7] ..... E05C 5/04
(52) U.S. Cl. ..... 292/251; 411/910
(58) Field of Search ..... 292/300, 301, 292/251, 256.73, 155; 312/223.1; 411/910, 107, 353, 544, 999, 347

(56) References Cited

U.S. PATENT DOCUMENTS

| | | | | | |
|---|---|---|---|---|---|
| 748,078 | A | * | 12/1903 | Kaisling | 292/251 |
| 885,568 | A | * | 4/1908 | Bennerscheidt | 292/251 |
| 1,398,036 | A | * | 11/1921 | Nichols | 292/251 |
| 1,480,338 | A | * | 1/1924 | Bacon | 70/90 |
| 1,639,661 | A | * | 8/1927 | Newcomb | 292/251 |
| 1,842,724 | A | * | 1/1932 | Langsner | 403/106 |
| 1,856,091 | A | * | 5/1932 | Dina | 292/251 |
| 2,187,605 | A | * | 1/1940 | Illsche | 292/251 |
| 2,256,100 | A | * | 9/1941 | Megela | 292/251 |
| 2,831,520 | A | * | 4/1958 | Clarke | 411/349 |
| 3,018,127 | A | * | 1/1962 | Dobrosielski | 292/251 |
| 4,796,150 | A | | 1/1989 | Dickey et al. | 361/119 |
| 5,791,701 | A | * | 8/1998 | Daould | 292/129 |

FOREIGN PATENT DOCUMENTS

| | | | | |
|---|---|---|---|---|
| FR | 997287 | * | 1/1952 | 411/347 |

* cited by examiner

*Primary Examiner*—Gary W. Estremsky
(74) *Attorney, Agent, or Firm*—Duane Morris & Heckscher LLP

(57) ABSTRACT

A cabinet includes a base having a receptacle. A door is pivotally connected to the base. A fastener is mounted to the door. The fastener has a head and a tip. The fastener has an extended position, in which the tip of the fastener projects from the door towards the receptacle. The tip of the fastener is attachable to the receptacle. A spring biases the fastener towards a retracted position, in which the tip of the fastener does not project from the door. A guide may be mounted to the door, for slidably receiving and aligning the fastener. A pair of cup washers may be included between the head of the fastener and the door. A downwardly facing cup washer contains the spring, and an upwardly facing cup washer provides security by preventing the fastener from being manipulated by a standard socket or wrench.

20 Claims, 5 Drawing Sheets

RETRACTABLE SAFETY MECHANISM FOR A CABINET

FIELD OF THE INVENTION

The present invention relates to the field of cabinets suitable for housing electronic devices, such as those used in telephone central offices or other locations.

DESCRIPTION OF THE RELATED ART

Interconnections between wirings such as telephone lines are made using connectors inside a cabinet that can be secured and, perhaps, locked. For example, a plurality of protection units for protecting telecommunications equipment against sneak currents and voltage surges may be stored in such a cabinet in telephone central offices or other locations. A panel containing such protection units is often housed in a cabinet that can only be opened using a special tool.

An example is a typical 216 type security mechanism. A hex type bolt is passed through a cup washer, and then through the door of the cabinet. A lock washer or clip secures the bolt to the door, so that the bolt protrudes from the inside of the door at all times. The bolt can be turned with a special tool, to secure the bolt to a receptacle in the cabinet.

To facilitate working in the cabinets, the cabinets are often placed at eye level. This creates a hazard, because the protruding bolt is likely to accidentally injure the eye of the technician working on the panel. Also, the protruding bolt is likely to scratch the technician.

A safer closure mechanism for a cabinet is desired.

SUMMARY OF THE INVENTION

The present invention is a retractable closure for a door of a cabinet. The cabinet has a receptacle. The closure comprises a fastener mounted to the door. The fastener has a head and a tip. The fastener has an extended position in which the tip of the fastener projects from the door towards the receptacle. The tip of the fastener is attachable to the receptacle. A spring biases the fastener towards a retracted position in which the tip of the fastener does not project from the door.

Another aspect of the invention is a method for operating a fastener mounted to a door of a cabinet having a receptacle. The fastener is extended to an extended position in which a tip of the fastener projects from the door towards the receptacle. The tip of the fastener is attached to the receptacle. The fastener is biased towards a retracted position in which the tip of the fastener does not project from the door.

DETAILED DESCRIPTION

Figure 2:
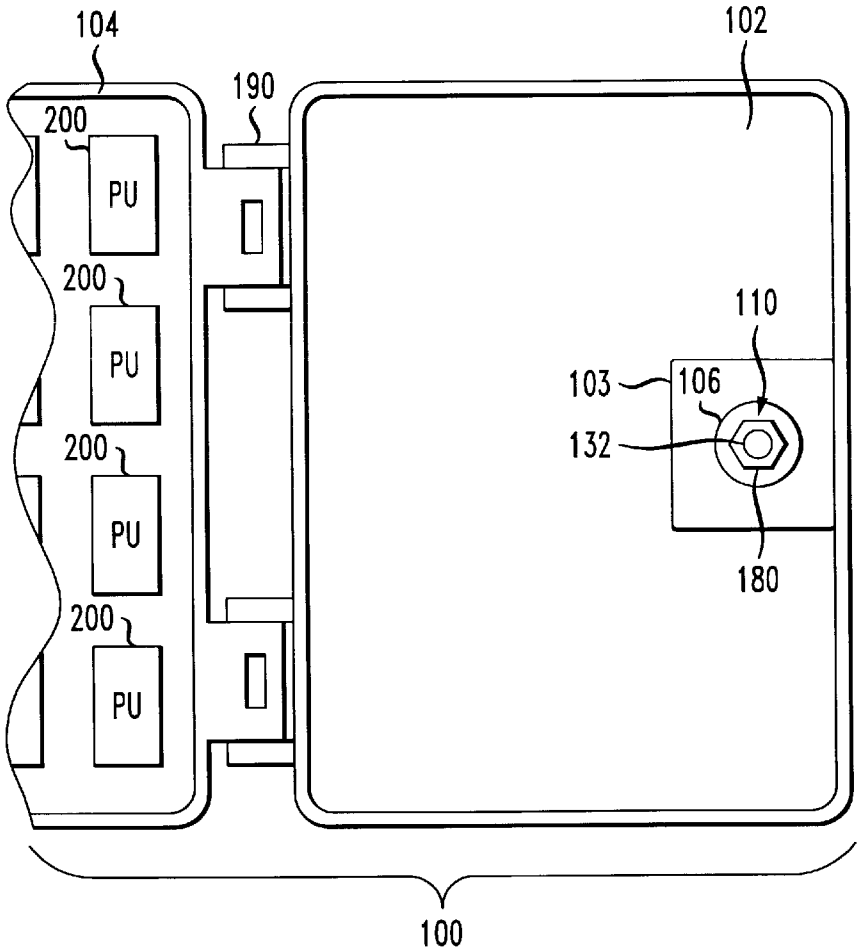
FIG. 2 is a rear elevation view of the door shown in FIG. 1.
Figure 1:
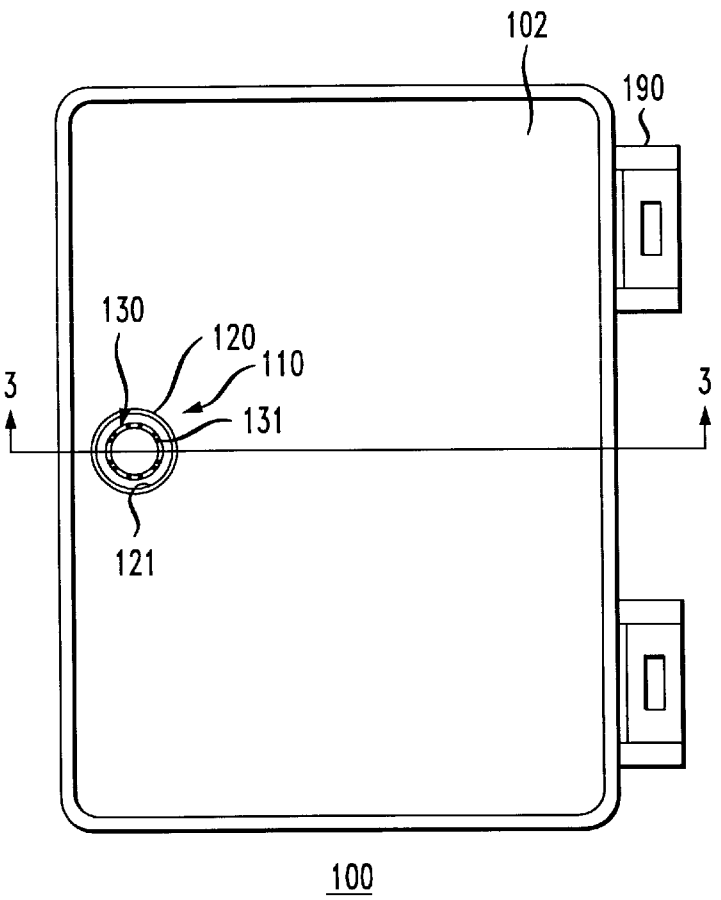
FIG. 1 is a front elevation view of a cabinet having a closure according to the present invention

FIGS. 1 and 2 show an exemplary cabinet 100 including an exemplary closure 110 according to the invention. FIG. 1 shows the door 102 of the cabinet 100 in the closed position. The exemplary closure 110 includes a fastener, which may be a hex head bolt 130 with a cup washer 120 beneath the bolt.

In the exemplary embodiment, the sizes of the cup washer 120 and bolt 130 are selected so that a space between the head 131 of the fastener 130 and the inner surface 121 of the cup washer 120 is sufficiently small to prevent a standard hexagonal socket from being placed over the head of the fastener inside of the cup washer. A special thin walled socket or tool must be used to loosen bolt 130. This serves as security mechanism.

FIG. 2 shows the interior of cabinet 100. The cabinet 100 has a base 104 and a hinge 190 for attaching the door 102 to the base. The bottom of the closure 110 is shown. The tip 132 of bolt 130 and a lock nut 180 are visible through an opening 106 in the compartment. The door 102 has a compartment 103 that houses the tip 132 of the fastener 130 while the fastener is in the retracted position (best seen in FIG. 4.) When the door 102 is open, the fastener 130 retracts into the compartment 103, so that it cannot inadvertently harm a technician working in the cabinet 100. Also shown in FIG. 2 are a plurality of protection units (PU's) 200 for protecting telecommunications equipment. The protection units may be, for example, of a type described in U.S. Pat. No. 4,796,150 to Dickey et al., which is incorporated by reference herein. Other protection units may be used.

Figure 3:
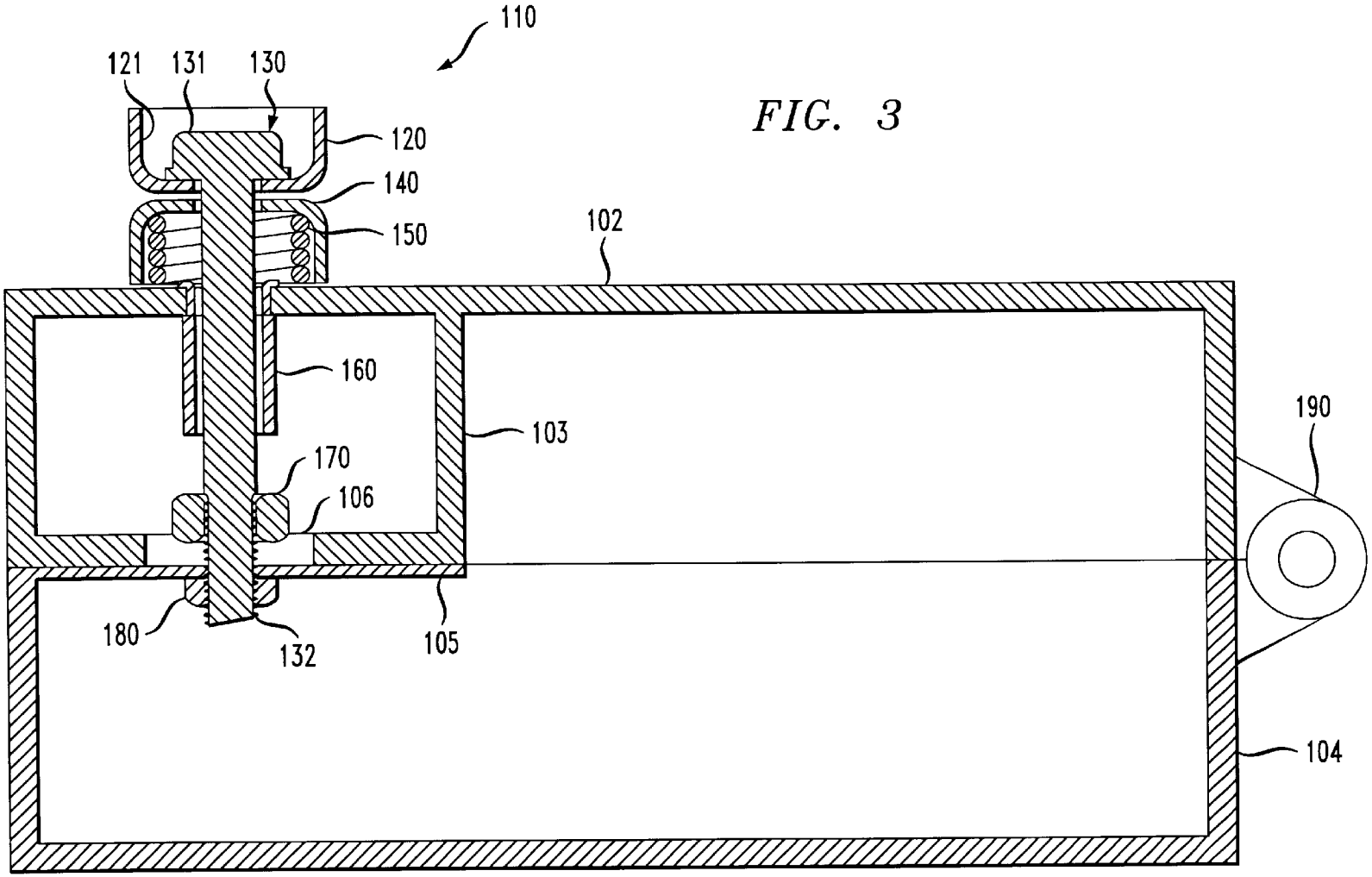
FIG. 3 is a cross sectional view of the cabinet of FIG. 1, taken along section line 3—3.
Figure 4:
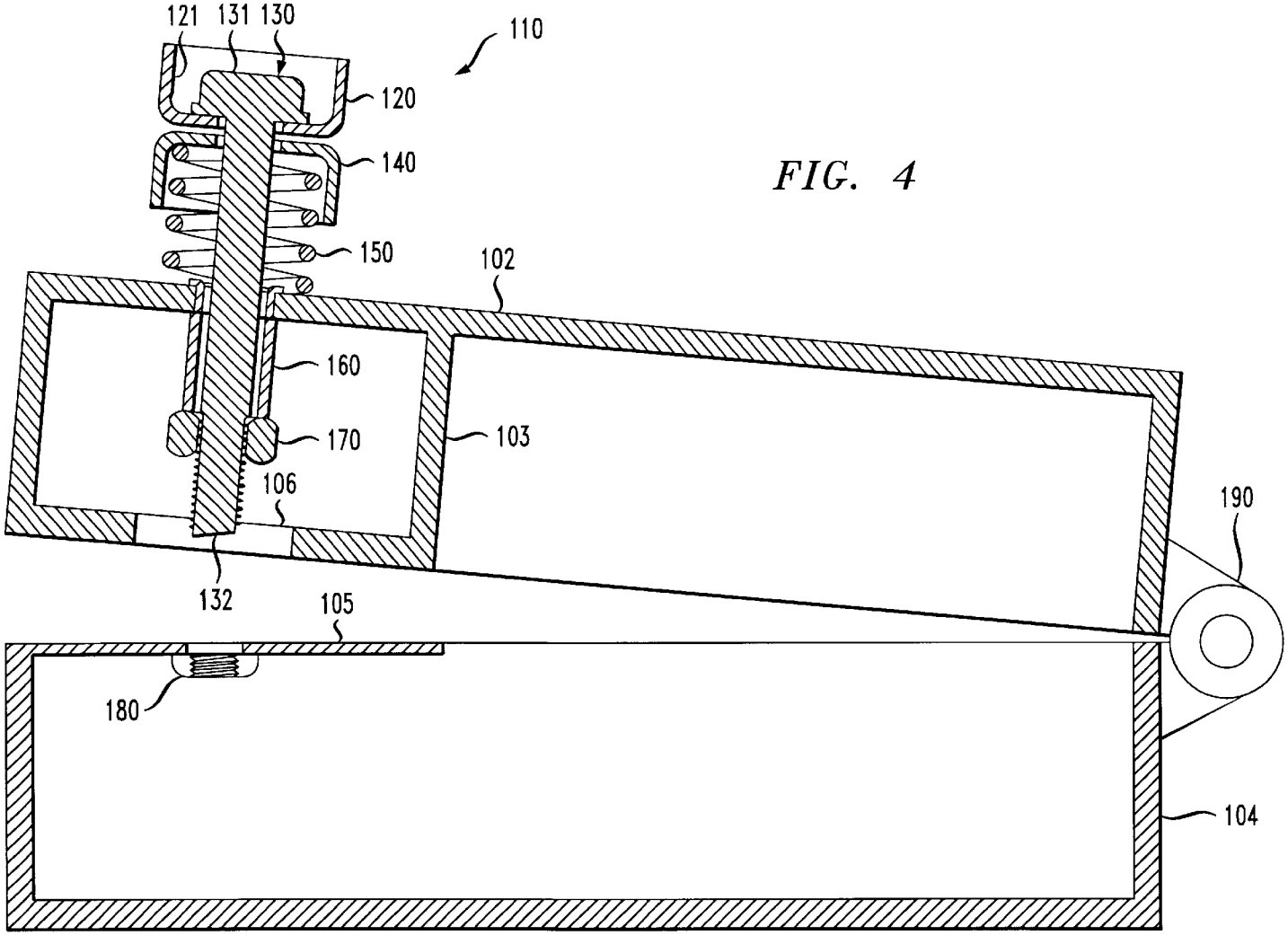
FIG. 4 shows the cabinet of FIG. 3, with the door open and the closure retracted.
Figure 5:
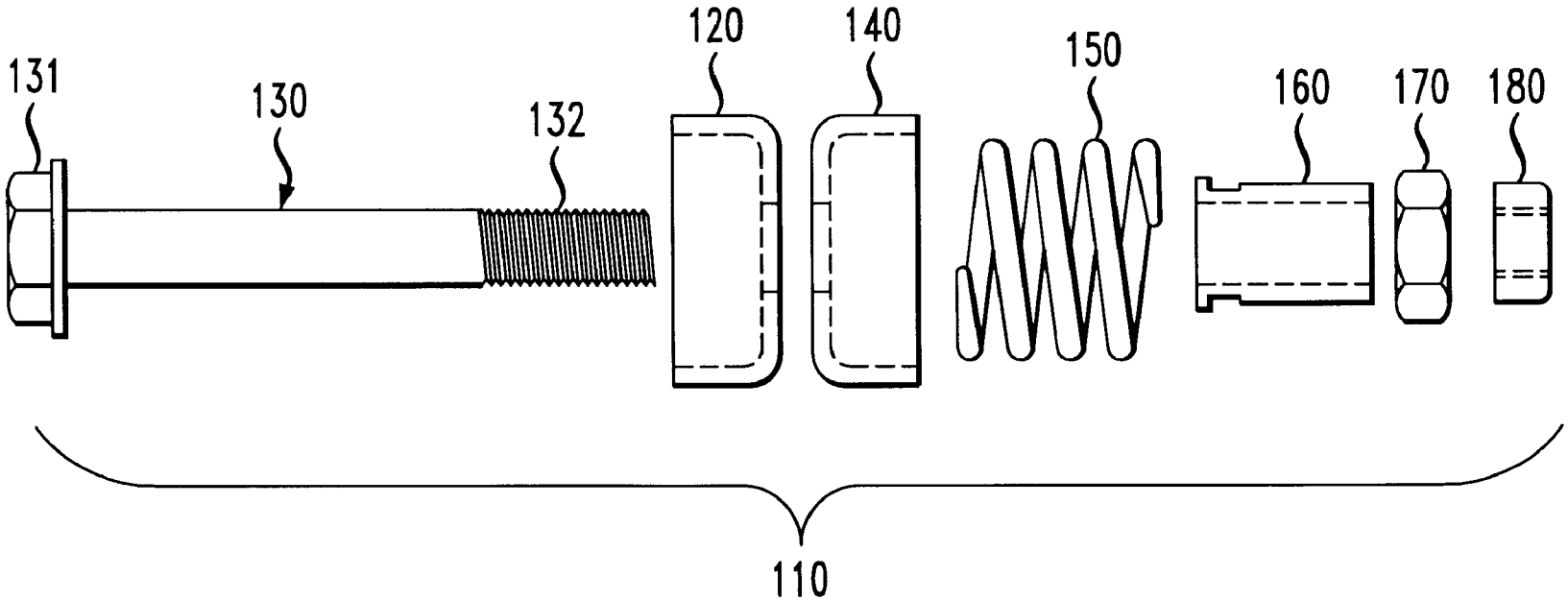
FIG. 5 is an exploded view of the closure of FIG. 3.

FIG. 3 is a cross sectional view of the cabinet 100, taken along section line 3—3 of FIG. 1. FIG. 4 shows the cabinet 100 with the door 102 opened, and the fastener 130 in its retracted position. FIG. 5 is an exploded view of the exemplary closure 110.

As shown in FIG. 3, the fastener 130 is mounted to the door 102 of the cabinet 102. The fastener 130 has a head 131 and a tip 132. The fastener 130 has an extended position (FIG. 3) in which the tip 132 of the fastener projects from the door 102 towards (or into) the receptacle 180. The tip 132 of the fastener 130 is attachable to the receptacle 180, in order to secure the cabinet, as shown in FIG. 3.

A spring 150 biases the fastener 130 towards a retracted position (best seen in FIG. 4) in which the tip 132 of the fastener does not project from the door 102. In the retracted position, the tip 132 is enclosed within the door 102 (described below with reference to FIG. 6), or within a compartment 103 of the door as shown in FIG. 4. The length of fastener 130 is selected so that the fastener engages the receptacle 180 when the fastener is extended, but the fastener does not project from the door while the fastener is retracted. To secure the door 102, the user pushes down on fastener 130 with a rotating tool, which may be a thin walled socket wrench. The fastener is turned until the door is secured.

Figure 6:
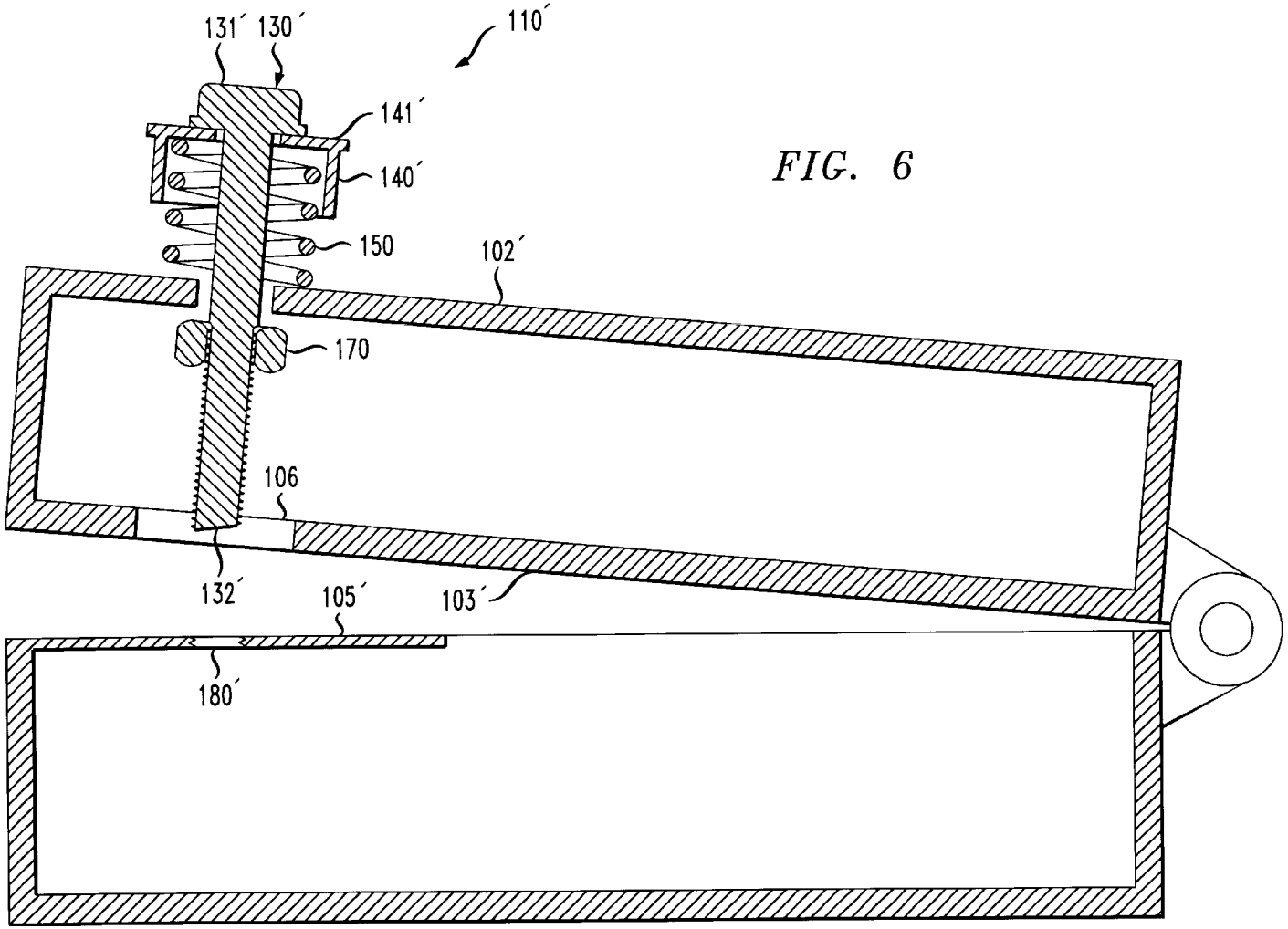
FIG. 6 is a cross sectional view of a variation of the exemplary embodiment.

Reference is again made to FIG. 3. The closure 110 may include means for retaining the spring 150. The retaining means may be, for example, a first cup washer 140 that contains the spring 150. The first cup washer 140 is mounted between the head 131 of the fastener 130 and the door 102. The retaining means may include other structures in place of the cup washer 140. For example, as shown in FIG. 6, a spacer 140' and a flat washer 141' may be used.

Reference is again made to FIG. 3. The closure 110 may include a second cup washer 120 mounted between the head 131 of the fastener 130 and the first cup washer 140. The second cup washer 120 has a concave surface 121 facing away from the door 102. An optional flat washer (not shown) may be included between the head 131 of fastener 130 and the cup washer 140, if the cup washer 120 is not included.

The closure 110 may further include a guide 160 mounted to the door 102. The fastener 130 is slidably received by the guide 160. The guide aligns the fastener 130 with the receptacle 180, for easy insertion of the tip 132 into the receptacle. The guide 160 may be in the form of a sleeve, and may be formed from a variety of materials, such as steel, aluminum, brass, other metals, nylon, tetrafluoroethylene (TFE) and the like.

The base 104 has a structure, such as an integrally attached tab 105, for supporting the receptacle 180. In the exemplary embodiment, the tip 132 of the fastener 130 has a male thread, and the receptacle 180 has a female thread. The receptacle may be a locknut 180 (as shown in FIG. 4). Locknut 180 may be welded or brazed to the tab 105. Alternatively, as shown in FIG. 6, the tip 132 of fastener 130 may screw directly into an opening 180' in the sheet metal 105'.

The closure 100 may include means for retaining the fastener 130 on the door 102. The exemplary retaining means may be a locknut 170. Alternatively, other retaining means, such as a retaining clip, a cotter pin and the like may be used for retaining the fastener 130 on the door 102.

FIG. 6 shows a variation of the exemplary embodiment. Components in FIG. 6 which are identical to those in FIG. 3 are indicated by like reference numbers, and components of FIG. 6 that are different from corresponding structures in FIG. 3 are indicated by primed (') reference numerals.

As shown in FIG. 6, a closure 110' according to the invention need not include two cup washers. A single concave downward cup washer (not shown) may contain the spring 150, or a spacer 140' and flat washer 141' may be used in combination. If the upward facing cup washer (FIG. 3) is not included, it is understood that a security feature is eliminated; the head 131 of fastener 130 can be accessed using a standard socket or wrench.

The closure 110' does not require a guide. It is understood that, in the absence of a guide, the bolt may wobble while in the retracted position, and the technician must manually align the tip 132 of the fastener 130 with the receptacle 180'.

As an alternative to the compartment 103 shown in FIG. 3, the entire door 102' may have sufficient thickness to retract the fastener 130' into the door, as shown in FIG. 6.

FIG. 6 shows that the receptacle need not be a locknut. A screw or bolt, such as fastener 130 can screw directly into a receptacle in sheet metal 105.

Alternative fasteners may be used in place of a bolt. For example, the fastener may be a quarter turn latch or screw (not shown). Alternatively, the fastener may have a tab at its end, and the receptacle may include a slot sized to receive the tab; when the tab is inserted and the screw rotated by about ninety degrees, the door is secured. Other equivalent structures may be used. Although the exemplary embodiment includes a hex head bolt, other fastener head configurations may be used. For example, a slotted head, Phillips head, or socket head may be used.

A closure according to the invention, and a cabinet including the closure, provide enhanced safety. A closure can be constructed according to the invention for protection of personnel, with inexpensive components. The invention does not interfere with the use of traditional security features, such as a lock or a specially configured fastener head. The invention does not interfere with the opening or closing of the cabinet, or increase the time to open or close the cabinet.

Although the exemplary cabinet contains protection units for telecommunications equipment, the invention may be used with other types of equipment, which may be telecommunications equipment. For example, in a large building, a cabinet having a closure according to the present invention may be used to house a network interface panel having a plurality of customer bridge devices. Further, the invention may be applied in any type of cabinet that is intended for installation at or near eye level, to provide improved safety.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A closure fastener mounted to a door of a cabinet, the cabinet having a receptacle, the closure fastener comprising:

a fastening having a head and a tip, the fastening mounted to the door and having an extended position in which the tip of the fastener projects from the door towards the receptable, the tip of the fastener being attachable to the receptacle; and a spring that biases the fastener towards the fastener towards a retracted position in which the tip of the fastener does not project from the door;

a first cup washer that contains the spring, the first cup washer being mounted between the head of the fastener snd the door; and a second cup washer mounted between the head of the fastener and the first cup washer, the second cup washer having a concave surface facing away from the door.

2. The closure of claim 1, wherein the second cup washer has an inner surface, and a space between the head of the fastener and the inner surface of the second cup washer is narrowly sized to allow a type 216 bolt tool to be placed over the head of the fastener inside of the second cup washer.

3. The closure of claim 1, wherein the tip of the fastener has a male thread, and the receptacle has a female thread.

4. The closure of claim 3, further comprising one of the group consisting of a locknut, a retaining clip and a cotter pin adapted to retain the fastener on the door.

5. The closure of claim 3, further comprising means for retaining the fastener on the door.

6. The closure of claim 1, further comprising means for retaining the spring.

7. The closure of claim 1, further comprising a guide adapted to be mounted to the door, the fastener being slidably received by the guide.

8. The closure of claim 7, further comprising retaining means positioned between the head and tip of the fastener and adapted for retaining the fastener on the door, wherein the guide acts as a spacer and limits retraction of the fastener when the retaining means abuts the guide.

9. The closure of claim 8, further comprising a receptacle separate and distinct from the retaining means, the fastener engaging the receptacle to move the fastener between the retracted position and the extended position.

10. The closure of claim 9, wherein the guide is separate and distinct from the receptacle.

11. A cabinet, comprising:

a base having a receptacle;

a door pivotally connected to the base;

a fastener mounted to the door, the fastener having a head and a tip, the fastener having an extended position in which the tip of the fastener projects from the door towards the receptacle, the tip of the fastener being attachable to the receptacle;

a spring that biases the fastener towards a retracted position in which the tip of the fastener does not project from the door;

a first cup washer that contains the spring the first cup washer being mounted between the head of the fastener and the door; and a second cup washer mounted between the head of the fastener and the first cup washer, the second cup washer having a concave surface facing away from the door.

12. The cabinet of claim 11, wherein the door has a compartment that houses the tip of the fastener while the fastener is in the retracted position.

13. The cabinet of claim 11, further comprising a guide mounted to the door, the fastener being slidably received by the guide.

14. The closure of claim 11, further comprising one of the group consisting of a locknut, a retaining clip and a cotter pin for retaining the fastener on the door.

15. The cabinet of claim 11, wherein the second cup washer has an inner surface, and a space between the head of the fastener and the inner surface of the second cup washer is narrow for limiting access to the head of the fastener.

16. A closure fastener for mounting to a door of a cabinet, the cabinet having a receptacle, the closure fastener comprising:

a fastener having a head and a tip, the fastener adapted to be mounted to the door and placed in an extended position in which the tip of the fastener projects from the door towards the receptacle, the tip of the fastener being attachable to the receptacle; and a spring adapted to bias the fastener towards a retracted position in which the tip of the fastener does not project from the door;

a first cup washer that contains the spring and a shaft portion of the fastener, the first cup washer being mountablr between the head of the fastener and the door, wherein the first cup washer has a concave surface that faces the door when the closure is in use; and a second cup washer mounted between the head of the fastener and the first cup washer and having side walls around the head of the fastener, the second cup washer touching the first cup washer and facing away from the first cup washer, the second cup washer having a concave surface adapted to face away from the door;

a nut connectable to the tip of the fastener, the nut being connectable with the receptacle for attaching the tip of the fastener to the receptacle.

17. A method for operating a fastener mounted to a door of a cabinet having a receptacle, the method comprising the steps of:

extending the fastener to an extended position in which a tip of the fastener projects from the door towards the receptacle;

attaching the tip of the fastener to the receptacle;

biasing the fastener towards a retracted position in which the tip of the fastener does not project from the door using a spring;

containing the spring with a first cup washer mounted between a head of the fastener and the door; and rotating the head of the fastener within a second cup washer mounted between the head of the fastener and the first cup washer, the second cup washer having a concave surface facing away from the door.

18. The method of claim 17, further comprising the steps of:

releasing the tip of the fastener from the receptacle, and retracting the fastener into the door.

19. The method of claim 17, further comprising the step of guiding the fastener so as to maintain alignment between the fastener and the receptacle.

20. The method of claim 17, wherein the fastener has a hex head, and the step of rotating includes rotating the hex head.

* * * * *